US012759760B2

(12) United States Patent
Candela

(10) Patent No.: US 12,759,760 B2
(45) Date of Patent: Oct. 13, 2026

(54) COLLAPSIBLE BEVERAGE CONTAINER

(71) Applicant: Brian Candela, Orlando, FL (US)

(72) Inventor: Brian Candela, Orlando, FL (US)

( * ) Notice: Subject to any disclaimer, the term of this patent is extended or adjusted under 35 U.S.C. 154(b) by 0 days.

(21) Appl. No.: 18/937,524

(22) Filed: Nov. 5, 2024

(65) Prior Publication Data

US 2025/0346400 A1 Nov. 13, 2025

Related U.S. Application Data

(60) Provisional application No. 63/645,588, filed on May 10, 2024.

(51) Int. Cl.
*B65D 5/36* (2006.01)
*B65D 21/08* (2006.01)
*B65D 41/04* (2006.01)

(52) U.S. Cl.
CPC ..... *B65D 21/086* (2013.01); *B65D 41/04* (2013.01)

(58) Field of Classification Search
CPC ..... B65D 5/746; B65D 5/067; B65D 5/3628; B65D 5/068; B65D 5/40; B65D 5/4266; B65D 1/0292; B65D 21/086; B65D 41/04; B29C 66/8322; B29C 65/08; B29C 66/53247; A47G 23/0258
USPC ..... 229/117.01; 222/105, 107; 383/98, 7, 383/906, 120; 220/666, 6
See application file for complete search history.

(56) References Cited

U.S. PATENT DOCUMENTS

| | | | | | |
|---|---|---|---|---|---|
| 393,899 | A * | 12/1888 | Haines | B65D 81/268 | 229/125.17 |
| 3,595,441 | A * | 7/1971 | Grosjean | B65D 35/44 | 222/541.2 |
| 5,076,493 | A * | 12/1991 | Anderson | B65D 5/067 | 229/125.14 |
| 5,255,808 | A * | 10/1993 | Tobler | B65D 1/0292 | 220/666 |
| 2010/0133329 | A1* | 6/2010 | Dickie | B65D 5/746 | 229/117.01 |

* cited by examiner

*Primary Examiner* — King M Chu
(74) *Attorney, Agent, or Firm* — Jason T. Daniel, Esq.; Daniel Law Offices, P.A.

(57) ABSTRACT

A collapsible beverage container includes a main body having a front wall, a back wall, a top wall, a pair of side walls and an interior space. An opening is positioned along the top wall, and a cap is secured to the opening via a twisting motion. The back wall includes a rigid construction, and the remaining walls include a malleable construction. The main body includes a plurality of living hinges along the front and side walls and transitions between an expanded position and a collapsed position. In the expanded position, the main body comprises a generally rectangular shape. In the collapsed position, the height and depth of the container are reduced, and the cap engages the bottom wall to secure and maintain the container in the collapsed position.

9 Claims, 4 Drawing Sheets

COLLAPSIBLE BEVERAGE CONTAINER

CROSS-REFERENCE TO RELATED APPLICATIONS

This application claims the benefit of U.S. Application Ser. No. 63/645,588 filed on May 10, 2024, the contents of which are incorporated herein by reference.

TECHNICAL FIELD

The following disclosure contemplates various embodiments of a collapsible and foldable beverage container.

BACKGROUND

The statements in this section merely provide background information related to the present disclosure and may not constitute prior art.

Reusable beverage containers are commonly used to store and carry beverages in any number of different situations. In virtually all instances, these containers are constructed from rigid materials such as plastic or metal, for example, and include a cylindrical shaped member having a removable cap along the upper surface to access the contents stored within.

Although good for the environment, the fixed shape and size of these containers is often a problem for individuals who are traveling and/or have limited storage space. As a result, many individuals routinely forgo the reusable bottle and instead utilize disposable plastic bottles that are discarded after use.

Accordingly, it would be beneficial to provide a collapsable beverage container that can transition between a fully collapsed position for storage, and a fully expanded position when in use, so as to overcome the drawbacks noted above.

SUMMARY OF THE INVENTION

The present invention is directed to a collapsible beverage container. One embodiment of the present invention can include a main body having a front wall, a back wall, a top wall, a pair of side walls and an interior space. An opening can be positioned along the top wall for engaging a cap via a twisting motion.

In one embodiment, the back wall can be rigid, and the remaining walls can be malleable in nature. The main body can include a plurality of living hinges along the front and side walls and can transition between an expanded position and a collapsed position. In the expanded position, the main body can comprise a generally rectangular shape. In the collapsed position, the height and depth of the container will be reduced, and the cap can engage the bottom wall to secure and maintain the container in the collapsed position.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 2:
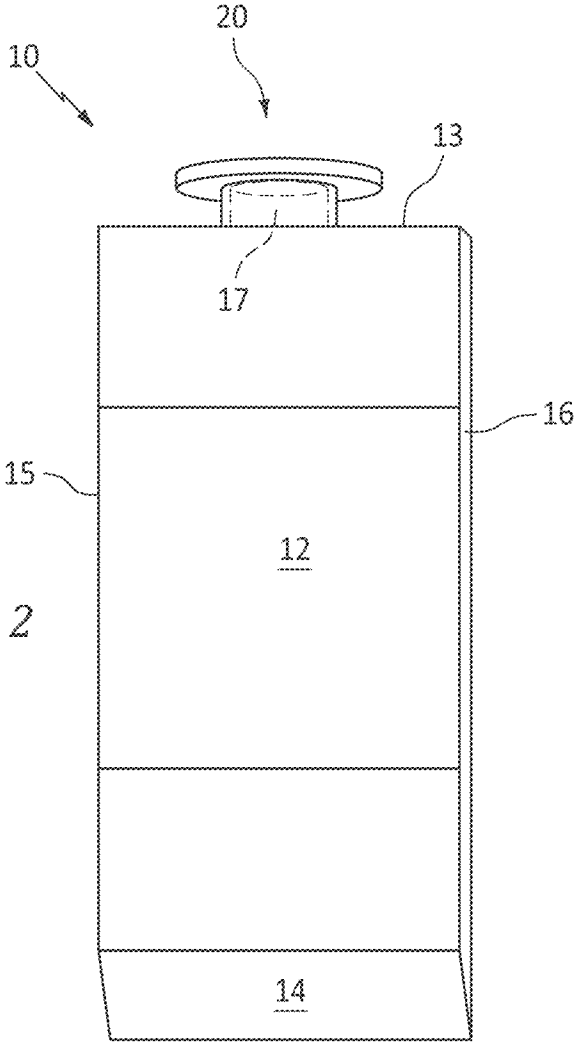
FIG. 2 is a back perspective view of the collapsible beverage container in accordance with one embodiment of the invention.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Definitions

As described herein, a "unit" means a series of identified physical components which are linked together and/or function together to perform a specified function.

As described throughout this document, the term "about" "approximately" "substantially" and "generally" shall be used interchangeably to describe a feature, shape, or measurement of a component within a tolerance such as, for example, manufacturing tolerances, measurement tolerances or the like.

As described herein, the term "removably secured," and derivatives thereof shall be used to describe a situation wherein two or more objects are joined together in a non-permanent manner so as to allow the same objects to be repeatedly joined and separated.

As described throughout this document, the term "complementary shape," and "complementary dimension," shall be used to describe a shape and size of a component that is identical to, or substantially identical to the shape and size of another identified component within a tolerance such as, for example, manufacturing tolerances, measurement tolerances or the like.

As described herein, the term "resilient memory" is defined as the ability of a component to maintain a particular shape and to attempt to return to the particular shape after being bent, folded, twisted, or otherwise manipulated.

FIGS. 1-7 illustrate one embodiment of a collapsible beverage container 10 that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

FIGS. 1-4 illustrate one embodiment of the container 10 in the expanded position. As shown, the container body can include a front wall 11, a back wall 12, a top wall 13, a bottom wall 14 and a pair of opposing side walls 15 and 16 that define a hollow interior space. An opening 17 can be positioned along the center of the top wall 13 having a threaded spout 18 for engaging a removable cap 20.

In the preferred embodiment, the container body will comprise a generally rectangular-shaped member when in the expanded position. Such a shape is important to allow the container to collapse into the fully flat and collapsed position shown at FIG. 7.

In one embodiment, the cap 20 can include a central body section 21 having a threaded opening 22 along the bottom end for receiving and engaging the complementary threads of the spout 18 via a twisting motion. The cap can include an upper body section 23 that extends outward from the central body section 22. As will be described below, the upper body section can function to engage a portion of the bottom wall 14 to secure the container in the collapsed position.

In the preferred embodiment, the container body will be constructed from a nonporous malleable material such as plastic, polyethylene coated paper, or wax coated paper so as to utilize the below described living hinges. In the preferred embodiment, the back wall 12 can further include a rigid layer of material such as hard plastic, for example to prevent this side of the container from folding or bending. Such a feature is important to provide a solid gripping surface and to permit the container to collapse in the manner described herein. Of course, the container body can be formed from any number of different nonporous material or combination of materials that are relatively light and strong for their weight and that are suitable for housing and storing liquids for human consumption.

In one embodiment, the main body can be constructed to include a plurality of folding sections at a plurality of specific locations to allow the container to transition between the expanded and collapsed positions. This can preferably be accomplished via a plurality of living hinges that are formed integrally with the container body, so as to ensure the container retains its watertight integrity at all times. Thus, in the preferred embodiment, two living hinges 25 and 26 can be provided along the front wall 11. Each of the hinges 25 and 26 can extend between the side walls 15 and 16 and can be positioned equidistantly from each other and the top and bottom walls 13 and 14, respectively, so as to form three front wall sections 11*a*, 11*b* and 11*c*.

Figure 3:
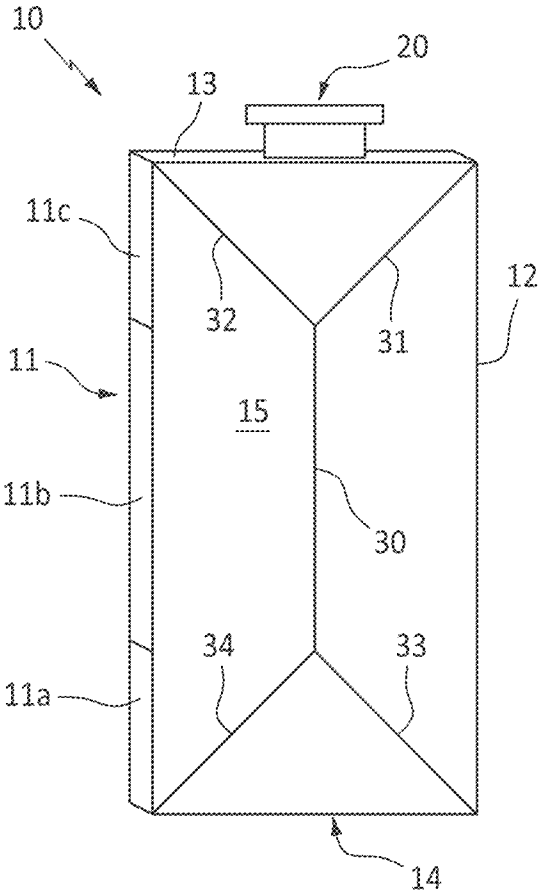
FIG. 3 is a right-side view of the collapsible beverage container in accordance with one embodiment of the invention.

As shown best at FIG. 3, the side wall 15 can include a central living hinge 30 that is positioned parallel to the front wall section 11*b*, and that is positioned equidistantly between the front wall the and the back walls 11 and 12. A pair of upper living hinges 31 and 32 can extend diagonally from the upper end of the central hinge 30 to terminate where the top wall 13 meets the back wall 12, and the front wall 11, respectively. Likewise, a pair of lower living hinges 33 and 34 can extend diagonally from the lower end of the central hinge 30 to terminate where the bottom wall 14 meets the back wall 12, and the front wall 11, respectively.

Figure 4:
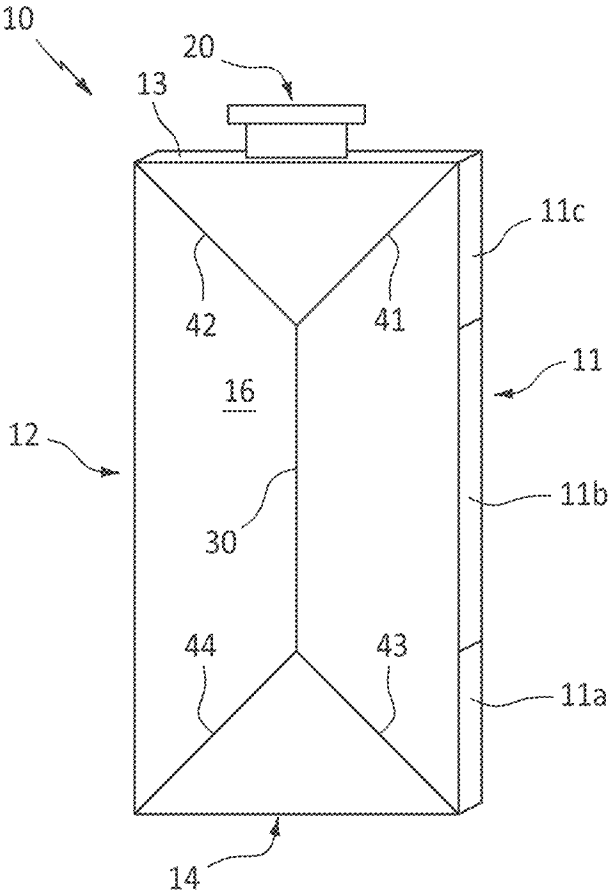
FIG. 4 is a left side view of the collapsible beverage container in accordance with one embodiment of the invention.

As shown best at FIG. 4, side wall 16 can also include a plurality of living hinges that include complementary shapes, sizes, and positions as the living hinges on the side wall 15. As such, side wall 16 can include a central living hinge 40 that is positioned parallel to the front wall section 11*b*, and that is positioned equidistantly between the front wall the and the back walls 11 and 12. A pair of upper living hinges 41 and 42 can extend diagonally from the upper end of the central hinge 40 to terminate where the top wall 13 meets the back wall 12, and the front wall 11, respectively. Likewise, a pair of lower living hinges 43 and 44 can extend diagonally from the lower end of the central hinge 40 to terminate where the bottom wall 14 meets the back wall 12, and the front wall 11, respectively.

Figure 5:
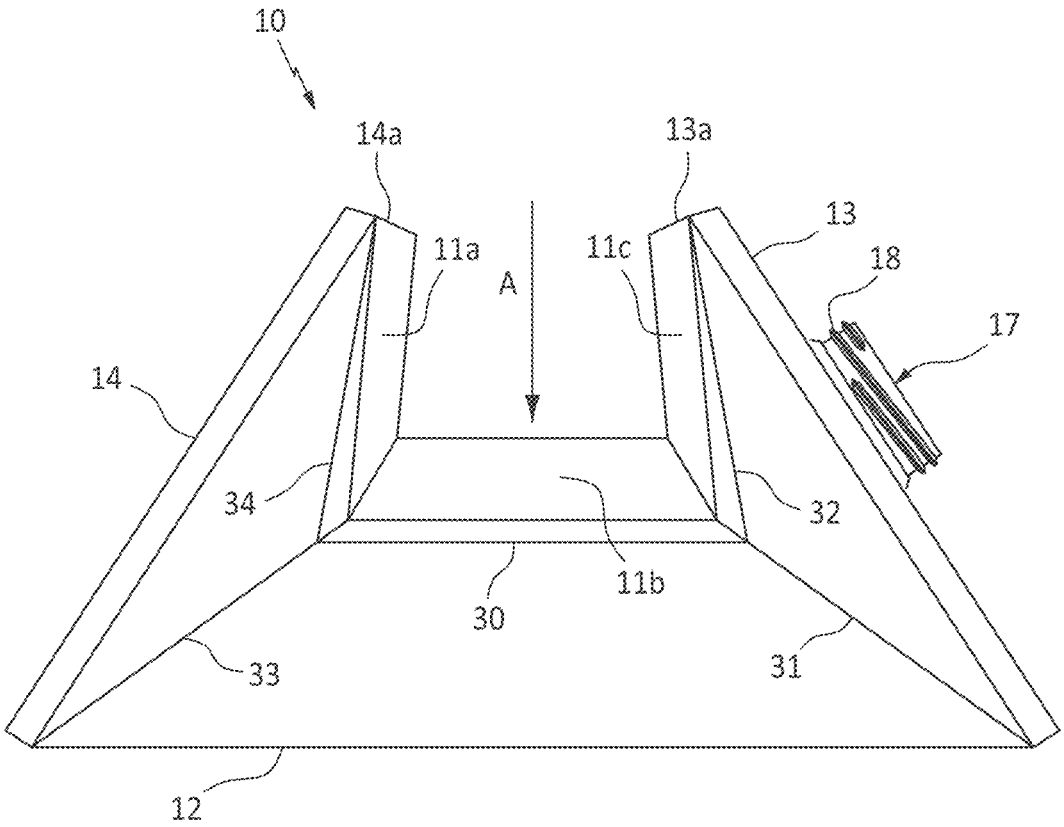
FIG. 5 is a side view of the collapsible beverage container in operation, in accordance with one embodiment of the invention.
Figure 6:
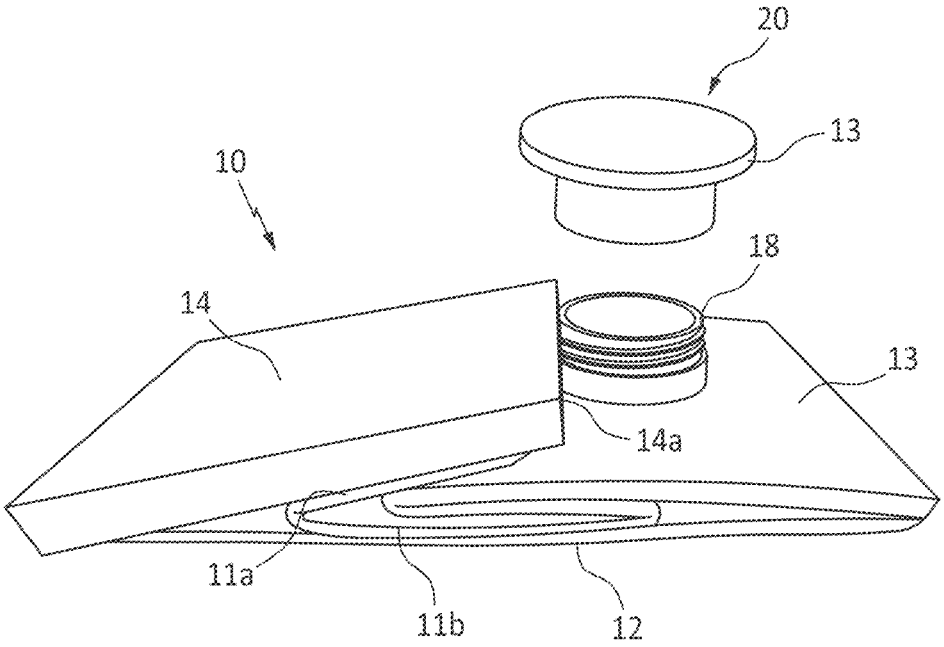
FIG. 6 is perspective view of the collapsible beverage container in operation, in accordance with one embodiment of the invention.
Figure 7:
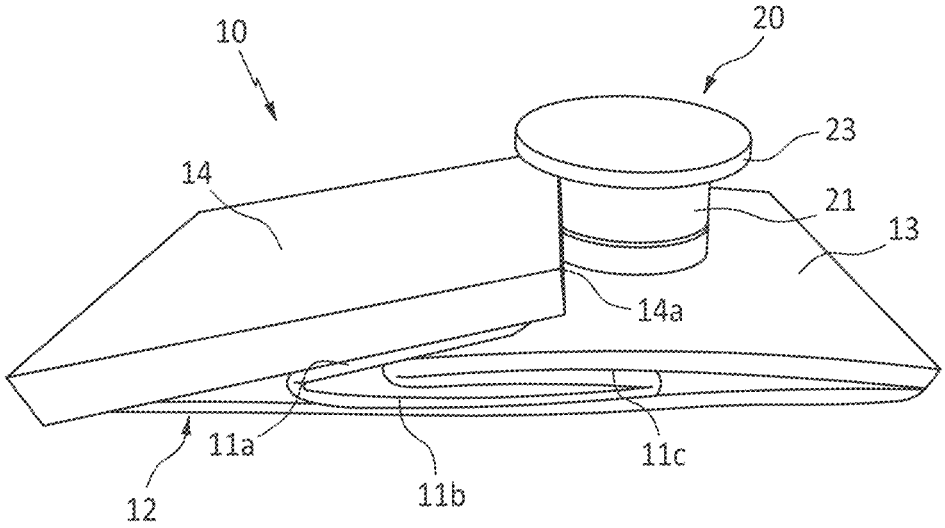
FIG. 7 is perspective view of the collapsible beverage container in the collapsed position, in accordance with one embodiment of the invention.

As shown FIGS. 5-7, the container can transition from the expanded position to the collapsed position by first removing the cap 20 to permit air within the container body to exit via the opening 17. Next, a user can push/squeeze the middle front wall section 11*b* toward the back wall 12 as shown by arrow A. This pressing force causes the side walls 15 and 16 to fold along each of their hinges such that the front edges of the top wall 13 and the bottom wall 14 begin to fold toward each other.

As the top and bottom walls continue to fold, the front edge 14*a* of the bottom wall 14 will be positioned on top of the top wall 13 and adjacent to the spout 18. Because the cap is designed such that the upper body section 23 extends outward from the central body section, the tightening of the cap will press the bottom of the body section 23 against the bottom wall, thus securing the container in the fully collapsed position shown at FIG. 7. In the collapsed position, the back wall 12, the middle front wall section 11*b*, and the top wall 13 will be completely flat and parallel to each other, with the bottom wall being positioned at a slight angle of between about 2 and 5 degrees.

Figure 1:
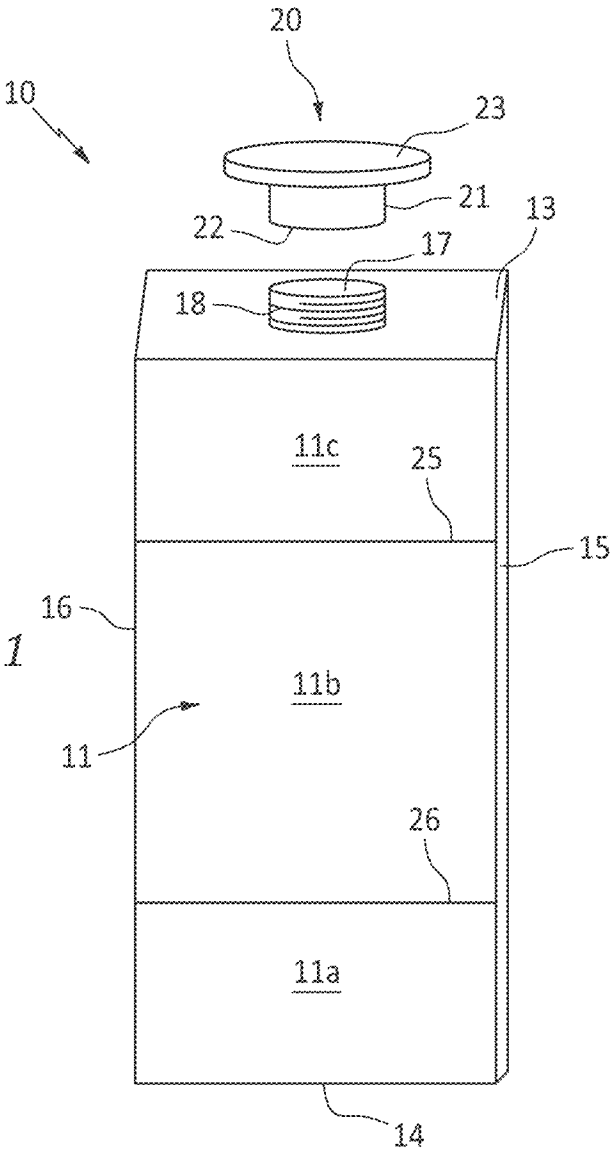
FIG. 1 is a front perspective view of a collapsible beverage container in the expanded position that is useful for understanding the inventive concepts disclosed herein.

When a user is ready to use the container again, they can simply remove the cap and allow air to enter the interior space, which will return the container to the expanded position shown at FIG. 1. In this regard, the container body has shape memory.

The inventive container described herein is designed to reduce its footprint in two different dimensions simultaneously. For example, the container in the collapsed position is reduced in depth (e.g., distance between front wall 11 and back wall 12) by 90 percent relative to the expanded position, so as to be less than ¼". Such features are important, as they ensure the device in the collapsed position is as flat as possible and occupies the least possible space within a backpack, purse or other carrying vessel when not in use.

As to a further description of the manner and use of the present invention, the same should be apparent from the above description. Accordingly, no further discussion relating to the manner of usage and operation will be provided.

As described herein, one or more elements of the device 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individually identified elements may be formed together as one or more continuous elements, either through manufacturing processes, such as welding, casting, or molding, or through the use of a singular piece of material milled or machined with the aforementioned components forming identifiable sections thereof.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the term "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A container, comprising:

a main body having a front wall, a back wall, a top wall, a bottom wall, a pair of side walls and an interior space;

an opening positioned along the top wall for providing access to the interior space;

a cap that is removably secured about the opening;

wherein the main body is configured to transition between an expanded position and a collapsed position and, in the collapsed position, the cap engages the bottom wall to secure and maintain the container in the collapsed position.

2. The container of claim 1, wherein in the expanded position, the main body includes a rectangular shape.

3. The container of claim 1, wherein at least a portion of the main body is constructed from a malleable nonporous material.

4. The container of claim 1, further comprising:

a first plurality of folding sections that are positioned along the front wall.

5. The container of claim 4, further comprising:

a second plurality of folding sections that are positioned along one of the pair of side walls.

6. The container of claim 5, further comprising:

a third plurality of folding sections that are positioned along the other one of the pair of side walls.

7. The container of claim 1, further comprising:

a threaded spout that is positioned about the opening on the top wall.

8. The container of claim 7, wherein the cap includes a central body section and an upper body section.

9. The container of claim 8, wherein the central body section includes a threaded opening that is configured to engage the threaded spout via a twisting motion.

* * * * *